United States Patent [19]

Persichillo

[11] Patent Number: 4,477,200

[45] Date of Patent: Oct. 16, 1984

[54] MULTIPLE PURPOSE PIPE CONNECTING BRACKETS

[76] Inventor: Frank J. Persichillo, 590 Sylvandale Ave., Oregon, Ohio 43616

[21] Appl. No.: 517,011

[22] Filed: Jul. 25, 1983

[51] Int. Cl.[3] ..... F16D 1/00; F16D 3/00

[52] U.S. Cl. ..... 403/174; 403/178

[58] Field of Search ..... 403/170, 172, 176, 174, 403/178; 114/361; 135/96, 106, 102

[56] References Cited

U.S. PATENT DOCUMENTS

| | | | |
|---|---|---|---|
| 100,966 | 3/1870 | Armstrong et al. | 135/106 |
| 1,092,217 | 4/1914 | Hopkins | 403/172 X |
| 1,202,255 | 10/1916 | Williams | 114/361 |
| 2,864,391 | 12/1958 | Stark | 114/361 |
| 3,354,892 | 11/1967 | Frieder | 114/361 |
| 3,957,069 | 5/1976 | Denaro | 135/106 X |

FOREIGN PATENT DOCUMENTS

| | | | |
|---|---|---|---|
| 545917 | 9/1957 | Canada | 135/106 |
| 414062 | 7/1946 | Italy | 403/397 |

*Primary Examiner*—Andrew V. Kundrat

*Attorney, Agent, or Firm*—George R. Royer

[57] ABSTRACT

The subject invention is a device for facilitating the interconnection of support rod members relative to one another in order to provide a unified and integrated frame member for supporting a boat covering, or similar device. The subject invention comprises mainly a bifurcated structure specifically supporting two opposing hollow cylindrical members aligned along a common central axis, with each adapted to hold the end of a support rod in the frame. An opening is provided through the bottom surface of the bifurcated member to receive a portion of a bolt member, which may be used to interconnect the subject device to another such similar device in a mutually perpendicular fashion. As thusly interconnected, the two connected devices provide a support intersection for interconnected rod members in the framework system.

2 Claims, 7 Drawing Figures

MULTIPLE PURPOSE PIPE CONNECTING BRACKETS

BACKGROUND OF INVENTION AND DISCUSSION OF PRIOR ART

The invention herein pertains to an arrangement for interconnecting bar or rod members adapted for rigid or semi-rigid connectors to function in such connected relationship as a frame member for supporting a tent, boat covering, or such other similar device, and wherein such frame is adapted to stand upright as the main support member. The field of art to which this invention relates includes a wide array of applications with the subject invention being used to facilitate and enhance connection of an unlimited number of such rod members to help form an integrated network.

The general category of devices which use frames comprised of inter-linked or interconnected rods or pipe-like members is a broad array, such as tents and boat coverings. In this regard, there exists in the present state of the art guite a wide variety of frame devices adapted for supporting tents or boat covering assemblies and the like. The invention herein provides a unique structural arrangement for interconnecting a plurality of rod members in a predetermined pattern so as to provide a convenient, safe, adjustable, and adaptable support arrangement.

It is noted, in this respect, that one of the problems with existing tent or boat covering frame members is that they are usually interconnected to the rod members in a rigid, fixed relationship and cannot be easily disconnected readily for reassembly or for reconstruction for new adaptations or other purposes. These prior art devices do not provide the flexibility for alignment and positioning of the spinal rod-like components so that they can be interpositioned or interconnected to one another to accommodate any desired shape or form for the tent-like structure or boat covering.

As can be seen, there is prevalent several problems encountered with the rigid type of attachment arrangement for the rod members, such as in a tent. It is not within the scope of this discussion of the prior art to elaborate on all such problems, however, it is expedient to indicate certain of the problems relative to which the subject invention is conceived. One such problem found is that many such tent or boat covering frame members do not have flexibly mounted and versatile interconnections which can be used for any type or shape of tent or covering, as desired or alternately interchanged from one use to another, such as from a boat covering frame to a tent frame, or other uses. Specifically, there is no practical, flexible, and interchangeable interconnecting mechanism which can be used in any manner or constructional arrangement as desired by the user to interconnect various rod members constituting the main frame members. The subject invention is conceived in order to surmount these problems so as to provide an improved interconnecting device to integrate frame rod members for any type of structure, and the following objects of the subject invention are directed accordingly.

OBJECTS

By reason of the above, the following are objects of the subject invention:

an object of the subject invention is to provide a versatile interconnector apparatus for interconnecting in a flexible manner rod members for a tent frame or boat covering frame, or similar such frames;

it is an object of this invention to provide a flexible adapter for attachment of rods in a boat covering frame and which is easily disassembled;

it is an object of the subject invention to provide an adaptable interconnecting device which requires no independent means to affix rod members in a tent frame or similar such frame;

another object of the subject invention is to provide an interconnecting adapter for connecting frame rod members that is easily assembled or connected in a manner of choice by the assembler for any potential usage;

yet another object of the subject invention is to provide an improved device for connecting frame component members in a tent frame;

another object of the subject invention is to provide a connecting device which is capable of interconnecting, in a flexible manner, rod members in a tent frame;

another object of the subject invention is to provide an apparatus which is used to efficiently interconnect the longitudinally extending frame members in a boat covering frame;

still another object of the subject invention is to provide a safe apparatus, which is simple in structure to hold tent frame members in place;

a further object of the subject invention is to provide an improved attachment adapter for boat cover frames that does not require extrinsic holding means in order to keep the frame in place;

still another object of the subject invention is to provide a connecting adapter for tent frames that is relatively simple to manufacture and assemble and disassemble to accommodate the frame design intentions of the user;

a further object of the subject invention is to provide a durable but lightweight interconnection device for boat coverings or tent frames;

it is an object of this invention to provide an improved object for stabilizing tent frame rod members relative to one another;

other and further objects of the subject invention will become apparent from a reading of the following drawings taken in conjunction with the description of the preferred embodiment.

DRAWINGS

DESCRIPTION OF GENERAL EMBODIMENT

Figure 2:
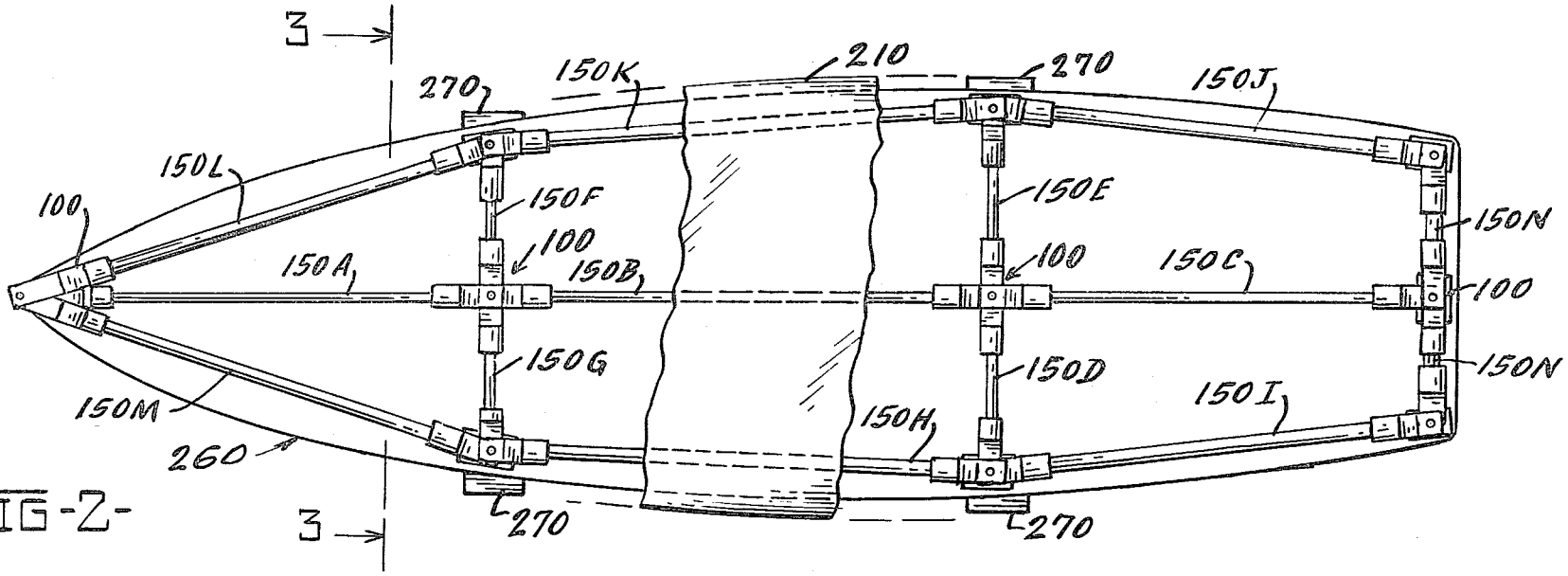
FIG. 2 is a top elevational view of the boat covering frame incorporating the subject invention.

The subject invention is a variable purpose adapter and connecting mechansim for linking together a plurality of rod members used to form an integrated tent frame or a boat cover frame or similar such framework member.

In the general embodiment of the subject invention, the main element of such invention is a bifurcated member which is constructed and formed around a U-shaped base member, having upwardly projecting opposing flanges. These opposing vertical flange members have outwardly directed faces, that is faces which are directed in opposing directions. Mounted on the outer faces of each vertical flange member is a hollow cylindrical member with the longitudinal central axis of each such cylindrical member being directed along a common axis, such common axis being perpendicular to the planar surface of the respectively conjoined outer flange face. Each hollow cylindrical member can hold therein the end of a frame rod member, so as to serve as an end support device for such frame rods or other longitudinal members.

The bottom portion of U-shaped base member is flat for a limited distance and has an opening or bore to receive a bolt member to affix to the one base member another such base member, with such interconnected base members being joined in a generally perpendicular manner in order that the respectively joined base members may hold frame rods extending in four radially extending directions. These directions may vary as discussed below.

DESCRIPTION OF PREFERRED EMBODIMENT

In the following description of a preferred embodiment of the subject invention, there will be a description of only one embodiment within the scope of the subject invention. Therefore, a description of a preferred embodiment of the subject invention shall not be considered as limiting the scope of the invention. Moreover, the preferred embodiment of the subject invention will be directed to application to a boat covering frame, however, the invention is equally applicable to tent frames and other frame devices.

It is to be stressed that in describing the preferred embodiment of the subject invention, the following definitions will be utilized. The word "frontal" will be used in reference to the front area of the object, while the words "posterior" or "rear" will be used relative to directions toward the rear of such device and generally extending towards a rearward direction therefrom. The words "longitudinal central axis" will refer to that axis which extends through the center, as seen in cross-section of an object from the one end to the other end thereof over its longest extent; or alternately stated, from one extreme point to the most distal point therefrom. The word "longitudinal" or "longitudinally extending" shall mean a direction extending more generally lengthwise in a given direction than otherwise. The word "transverse" will mean the lateral or width distance over a given object, which will be considered generally perpendicular to the longitudinal central axis of such object. The word "upper" will refer to areas above the ground when the object is in its intended position. The word "lower" will refer to those areas extending towards the ground reference. In this latter respect, the ground reference will be considered level or horizontal.

Figure 1:
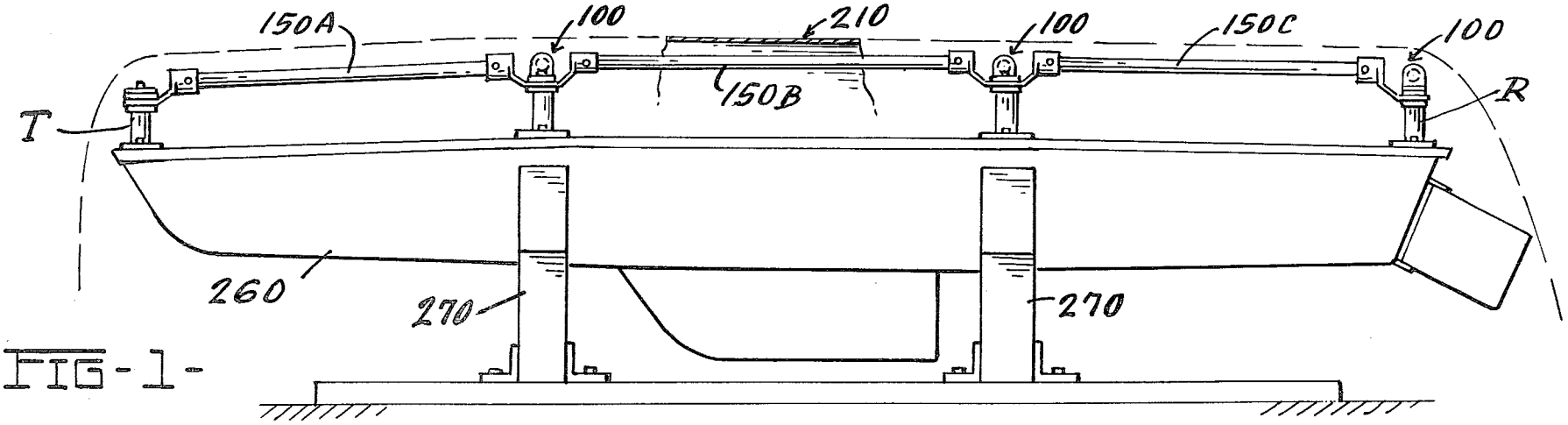
FIG. 1 is a side elevational view of a boat covering frame utilizing the subject invention.
Figure 3:
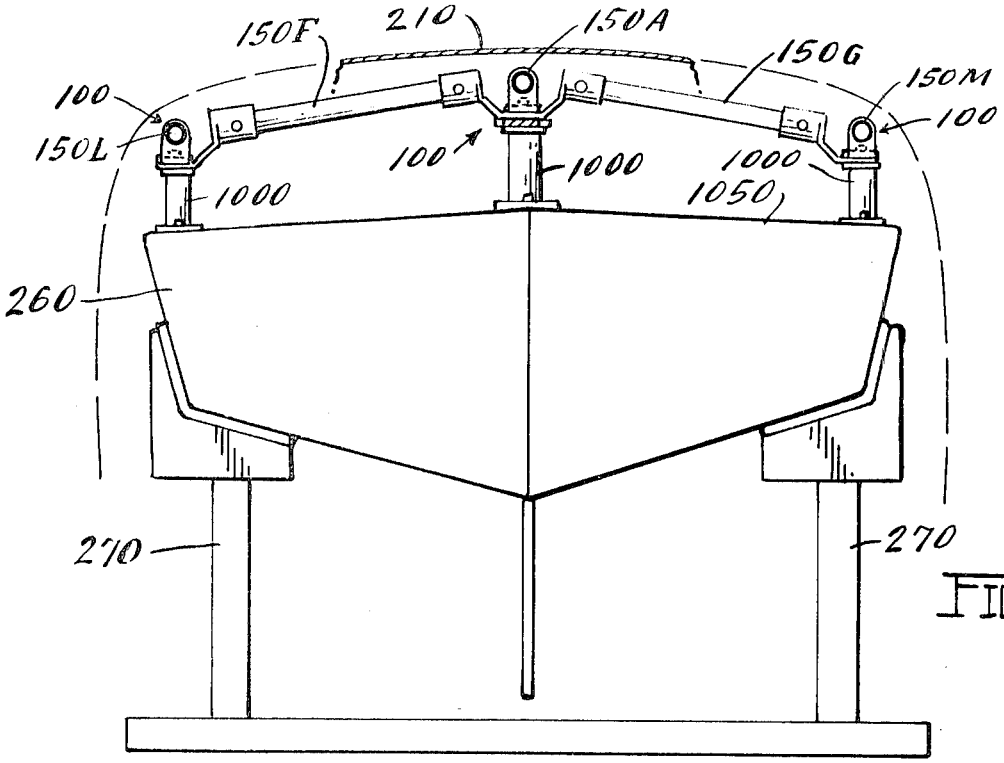
FIG. 3 is an end view of the boat covering frame incorporating the subject invention.

Attention is addressed initially to FIGS. 4, 5, 6 and 7 of the drawings which show one preferred embodiment of the subject invention, which show an all-purpose connector apparatus 100, embodying the features of the subject invention. Such adapter apparatus 100 is constructed primarily as a flexible connecting member functioning to join cylindrically formed rod-like members 150A, 150B . . . which rod members function as the primary spinal support members which are joined to one another in a fixed relationship to form a frame 210 for a boat covering 240, as shown in FIGS. 1, 2, and 3. In the usual application, such rod members 150A, 150B . . . are interconnected in a vertical, horizontal or other angled relationship in order to form a latticed-like frame member, such as frame 210. The multiple rod members 150A, 150B . . . are thus integrated together into a suitable frame to receive canvas covering 240 over the top thereto to cover boat 260 on stand 270, as shown in FIG. 3. The invention as embodied in connector apparatus 100 can be used to form any desired shape or structured framework.

Figure 4:
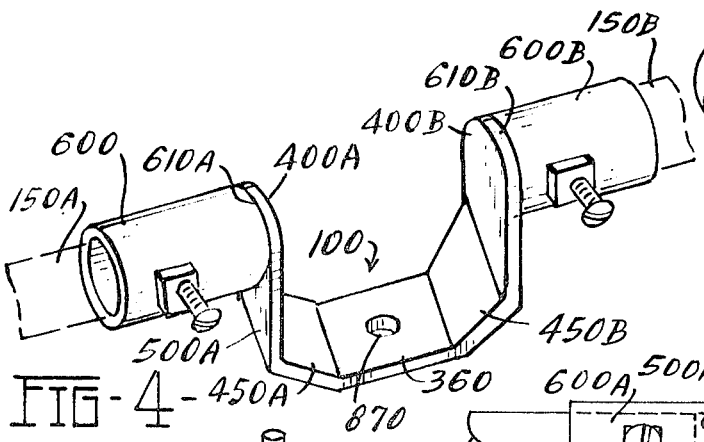
FIG. 4 is a perspective view of the subject connecting device.
Figure 5:
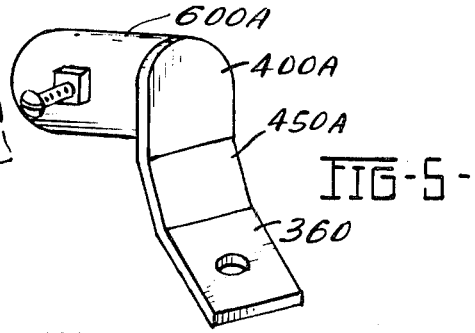
FIG. 5 is a perspective view of one portion of the subject connecting device.
Figure 7:
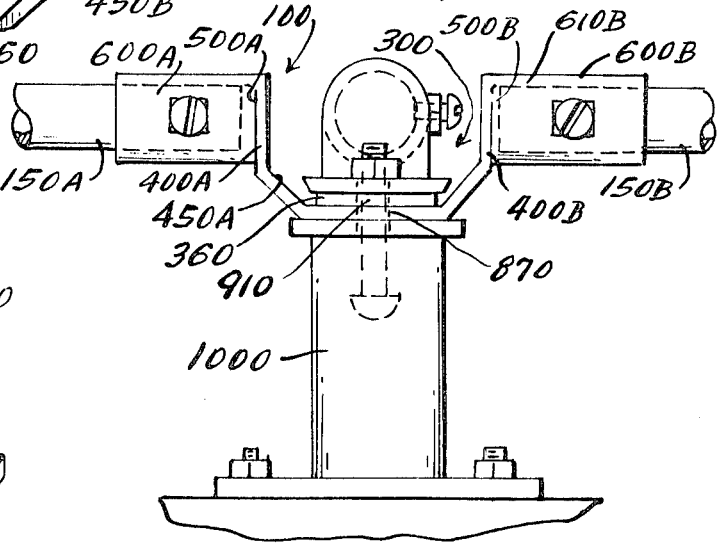
FIG. 7 is a side elevational view of the subject invention.

The base member for connector 100 is a U-shaped base member 300, formed with a flat bottom member 360, joining the opposing vertically disposed flange members 400A and 400B, as shown in FIG. 4. These vertical flange members 400A and 400B are joined on their upper part to intermediately disposed and upwardly extending flat plate-like extensions 450A and 450B extending from the flat bottom member 360, as shown in FIG. 4. These plate-like extensions 450A and 450B extend upwardly from the flat bottom member 400 at an angle as seen in FIGS. 4 and 7. More particularly, the upper surfaces of the members 450A and 450B are inclined upwardly at an angle, relative to the upper surface of the flat bottom member 360, at an angle of approximately forty-five degrees (45°) and at its top edge it joins the lower edge of the respectively joined vertical flange member, as shown. This is not considered a critical angle for purposes of this invention, however.

Joined to the outer flat face 500A and 500B of each vertical flange 400A and 400B are hollow cylindrical members 600A and 600B, as shown. As observed, the flat faces 500A and 500B of vertical flanges 400A and 400B are directed in mutually opposing directions. On face 500A, cylinder 600A is joined with the end 610A being affixed to such face so that the circumferential edge of end 610A is flush against the face 500A. By this latter constructional arrangement, the longitudinal central axis of cylinder 600A is perpendicular to the outer face 500A of the vertical flange 400A. Cylinder 600B is joined in a similar manner to face 500B on flange 400B.

The hollow cylindrical cavity 800A in cylinder 600A is directed away from face 500A with the opening 820 in the end thereof being projected away from such face accordingly. This hollow cylindrical cavity is adapted to receive conformingly the end of a frame support rod 150A, also of cylindrical configuration. Thus, as can be seen, each cylinder 600A and 600B can hold securely therein a correspondingly shaped and sized support rod member. In this fashion the connector 100 can support two opposing rod members of any length or disposition. Any number of connector devices, such as connector 100 can be used to construct any shape or form for a boat framework or other framework as conceived by the person using the subject device as a base. The framework 210 shown in FIGS. 1, 2, and 3 is only one example of such a framework that can be constructed with the subject device.

Figure 6:
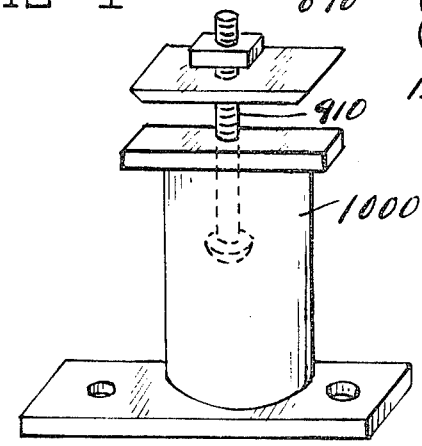
FIG. 6 is a perspective view of a vertical support stand that can be optionally used in the subject invention.

One of the features of the subject invention that enables connector 100 to be joined, in a perpendicular manner, with other such connecting devices is the U-shaped form of the base 300 in conjunction with flat bottom member 360 on the lower part of the base member 300. In this respect, the bottom plate 360 has a circular base 870 therein to receive an appropriately sized bolt member 910, as shown in FIG. 7. Thus, as shown in FIGS. 1, 2, 3 and 7, the bottom surface 360 of two separate connection devices 100 can be joined together in a perpendicular manner, with the respective cylinders being directed in equally spaced radial directions. This feature enables four rod members to join together in an intersection of the frame 210, as shown. In this respect, a vertical stanchion 1000, as shown in FIGS. 6 and 7, can be used to support, vertically upwardly, from a deck surface 1050, the intersected connectors, as shown in FIGS. 3 and 7.

Yet another versatile feature of the subject invention is that a vertical flange plate 400 and intermediate plate 450 can be bent downwardly, at any distance or angle towards flat plate member 360. One such connector, with the flange moved downwardly to accommodate the desired conformed shape of the frame 210, is shown at R and T in FIG. 1.

While a preferred embodiment of the subject invention has been described, it is to be understood that it stall not be considered as limiting the scope of the subject invention.

I claim:

1. A rod interconnecting device for a frame member comprising:

(a) a U-shaped base frame member, having a flat-bottom surface, said base surface having a rectangular upper surface and said base having a first opposing edge and second opposing edge parallel to one another said respective edges being formed of the respective opposing edges of said rectangular surfaces;

(b) first and second flange members integrally connected respectively to the base member at said first and second edges respectively, said flange member being directed in a plane which is disposed at an angle to the upper surface of said member;

(c) connecting means on said base member to interconnect said device to support means independent of said base member;

(d) rod receptacle means integrally disposed perpendecularly on each of said flange members to receive and hold the ends of rod members therein.

2. A device for interconnecting rod-like members to a frame member wherein a plurality of said-rod-like members function as the skeleton members for said frame member comprising:

(a) a base bracket member having a flat-bottom portion with a first and second end each with flange members extending from and terminating vertically upward from the respective first and second ends;

(b) hollow tubular members extending perpendicularly from the outer walls of such flange members.

* * * * *